US006761110B2

(12) United States Patent
Stark et al.

(10) Patent No.: US 6,761,110 B2
(45) Date of Patent: Jul. 13, 2004

(54) METHOD FOR INTERLEAVING SHEETS

(75) Inventors: Siegfried Alfons Stark, Rottendorf (DE); Reinhold Dünninger, deceased, late of Würzburg (DE), by Brigitte Dünninger, heir

(73) Assignee: KBA-Giori S.A., Lausanne (CH)

( * ) Notice: Subject to any disclaimer, the term of this patent is extended or adjusted under 35 U.S.C. 154(b) by 0 days.

(21) Appl. No.: 10/168,784

(22) PCT Filed: Oct. 18, 2001

(86) PCT No.: PCT/IB01/01951

§ 371 (c)(1),
(2), (4) Date: Sep. 30, 2002

(87) PCT Pub. No.: WO02/32669

PCT Pub. Date: Apr. 25, 2002

(65) Prior Publication Data

US 2003/0089253 A1 May 15, 2003

(30) Foreign Application Priority Data

Oct. 20, 2000 (CH) ..... 2059/00

(51) Int. Cl.[7] ..... B41F 9/02; B41M 1/10

(52) U.S. Cl. ..... 101/170; 101/152; 101/419; 101/483

(58) Field of Search ..... 101/150, 152, 101/155, 170, 232, 240, 483, 419; 270/18

(56) References Cited

U.S. PATENT DOCUMENTS

| | | | | | |
|---|---|---|---|---|---|
| 1,693,886 | A | * | 12/1928 | Catno et al. | 101/417 |
| 2,158,552 | A | * | 5/1939 | Potdevin | 101/419 |
| 2,647,463 | A | * | 8/1953 | Ferrar | 101/419 |
| 2,659,305 | A | * | 11/1953 | Giori | 101/175 |
| 3,029,731 | A | * | 4/1962 | Bussey | 101/419 |
| 4,409,741 | A | | 10/1983 | Bonomi | |
| 4,516,496 | A | * | 5/1985 | Giori | 101/152 |
| 5,282,417 | A | | 2/1994 | Germann | |

FOREIGN PATENT DOCUMENTS

| | | |
|---|---|---|
| EP | 0039526 A | 11/1981 |
| EP | 0563007 A | 9/1993 |

* cited by examiner

*Primary Examiner*—Andrew H. Hirshfeld
*Assistant Examiner*—Leo T. Hinze
(74) *Attorney, Agent, or Firm*—Bugnion S.A.; John Moetteli

(57) ABSTRACT

A method by which stacks of printed sheets can be formed and, at the same time, the risk of soiling of the stacked sheets can be reduced to the maximum extent. To this end a printing machine is proposed, in particular a sheet-fed printing machine, into which unprinted and intermediate sheets are alternatively feed, wherein the printing is registered such that the printing occurs only on the unprinted sheets and not on the intermediate sheets. In this way, the intermediate sheets prevent damage to the print on the printed sheets.

3 Claims, 3 Drawing Sheets

METHOD FOR INTERLEAVING SHEETS

BACKGROUND OF THE INVENTION

The present invention relates to a method of producing stacks of sheets printed with individual prints, in particular stacks of securities sheets, such as banknotes, from stacks of unprinted sheets, the unprinted sheets running into a printing machine one after another in order to be provided with the individual prints.

The present invention likewise relates to a printing machine for the implementation of the method according to the invention.

Methods of producing stacks of securities sheets and machines for the implementation of these methods are known from the current prior art. For example, the patent EP 0 563 007, the content of which is incorporated by reference, discloses a copper printing machine of modular construction which, in particular, contains an impression cylinder on which the sheets to be printed are firmly held, and a plate cylinder which in turn carries copper printing plates into which the printing motifs transferred to the sheets of the impression cylinder are engraved. In the known machine, the inking of the printing plates is carried out both on an indirect route by means of an ink collecting cylinder, which collects the ink from a plurality of ink ductors and subsequently transfers it to the plates of the plate cylinder, and on a direct route via an ink applicator cylinder, which is laid directly on the printing plates.

The method of producing the stack of printed sheets comprises, in particular, the transfer of the unprinted sheets from the feed stack to the impression cylinder, then the actual printing of the sheets with the motifs, the motifs being formed by means of the inked plates of the plate cylinder, and finally the onward transport of the printed sheets to a delivery stack.

One difficulty which occurs in certain printing machines, in particular in machines in which the copper printing process is applied, is the problem of ink drying. In such a printing process, the amount of ink actually applied to each sheet is rather large, and it is absolutely necessary for the ink to be dried before the sheets are stacked in the delivery of the machine. This is because, if the ink has had no time to dry completely before being stacked, the sheets then soil one another and can have faults in some prints or then even become completely unusable. Faults of this type have to be reduced to the maximum extent possible, in particular on account of the costs of the sheets used for printing securities and also because of the problems which subsequently occur in the phase of numbering the individual securities, which is carried out consecutively. Each security which has a fault has to be replaced by an individual fault-free security.

Thus, in the current prior art, the proposal has been made to equip the printing machines with an ink drying device. A device of this type is described, for example, by EP 0 039 526, the content of which is incorporated by reference. It primarily comprises a chain gripper system, which transports the freshly printed sheets at constant intervals to a heat source. One of the objects of this system was to save the insertion operation, as it is known, which consisted in a white sheet being inserted between each printed sheet, in order to prevent the printed sheets sticking to one another.

In the case of other machines of the known prior art, the two systems mentioned above (namely, a drying system and a system inserting intermediate sheets) have also been combined. In a machine known from the current prior art, as illustrated in FIG. 1 of this application, drying devices such as lamps or other equivalent means are provided, which permit the printed sheets to be dried before being stacked. After the sheets have been printed, they are conveyed through an output device which, for example, contains a chain gripper system, and during the passage through this, output device, heat sources act on the sheets and the ink is dried.

In order to improve this machine, it was provided with a special feed device for intermediate sheets beside the delivery stack of the printed sheets. With the aid of this feed means, between each printed sheet an intermediate sheet of paper is placed, with which the printed sheets are better protected from one another. The paper used for the intermediate sheets is also cheaper than the paper used for the securities sheets, so that this principle is very advantageous.

The use of intermediate sheets also constitutes a practical solution, in particular for small machines or when there is little space and it is therefore not possible to install an appropriate drying device, as described above. Nevertheless, in the case of small machines it is also complicated to insert intermediate sheets between each printed sheet, since the production speed is high and the paths traced by each printed sheet are short.

SUMMARY OF THE INVENTION

The object of the invention is to improve the known methods and machines.

In particular, the invention has the object of proposing a method with which stacks of printed sheets can be formed and, at the same time, the risk of soiling of the stacked sheets can be reduced to the maximum extent.

The object of the invention is also to propose a printing machine, in particular a sheet-fed printing machine, which permits the use of the method.

This object is achieved by the method and the machine which are defined in the independent claims.

Particular types of embodiment of the method and of the machine according to the invention are defined by the independent claims.

BRIEF DESCRIPTION OF THE INVENTION

The invention will be better understood through the description of a type of embodiment of this invention and the figures relating thereto.

DETAILED DESCRIPTION OF THE PREFERRED EMBODIMENTS

Figure 1:
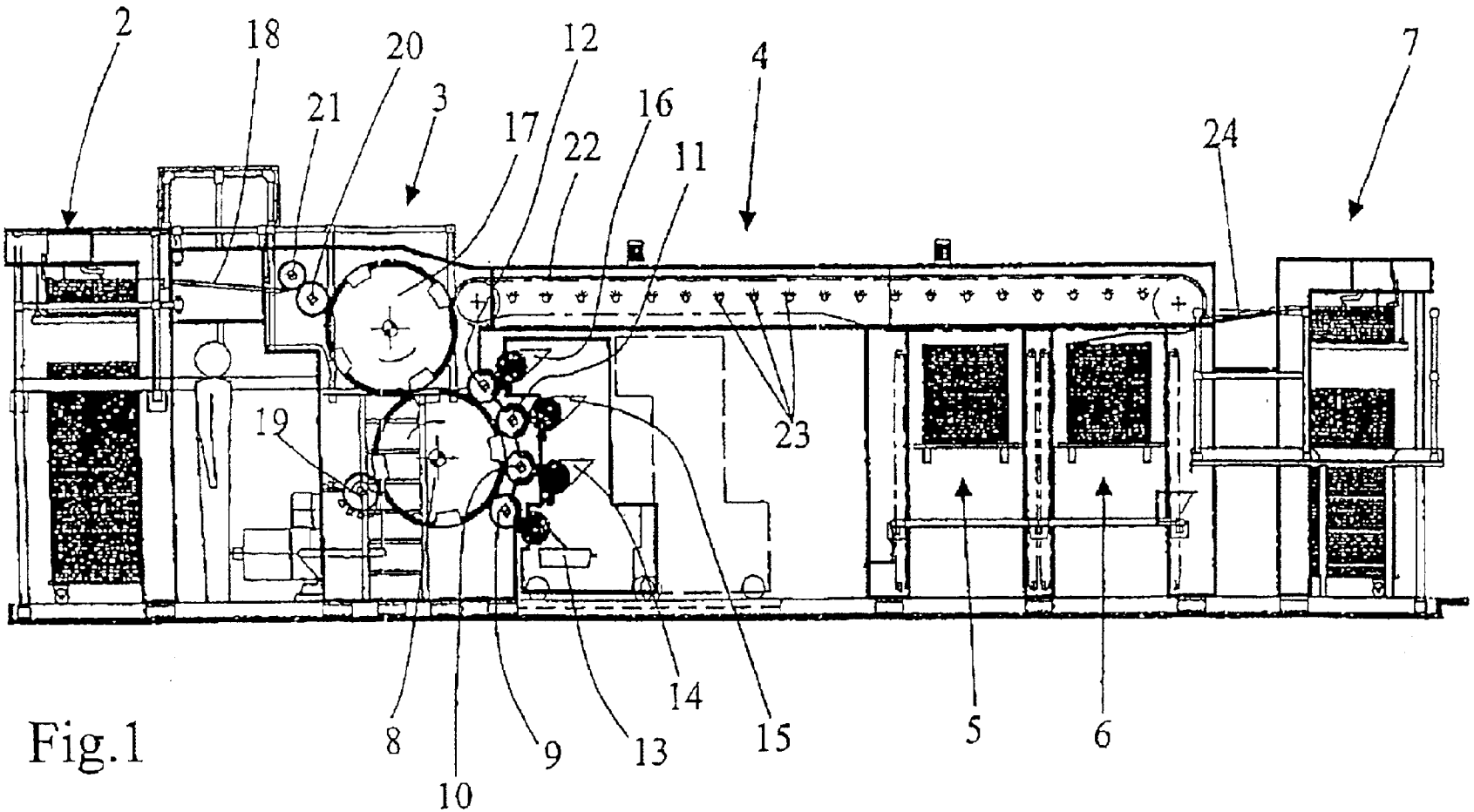
FIG. 1 shows, in schematic form, a printing machine known from the current prior art.

A known machine from the current prior art will be described with reference to FIG. 1. This machine is designated generally by the reference number 1 and comprises the following parts: a feed 2 for the sheets to be printed, a printing module 3, and a transport system 4, with which the printed sheets arc transported to the delivery systems 5 and 6 of the machine 1. This machine additionally comprises a feed for intermediate sheets 7 beside the delivery systems 5 and 6.

Put more precisely, the printing module 3 comprises a plate cylinder, which is inked by ink applicator rolls 9 from the ink fountains 13, 14, 15 and 16. The module further comprises an impression cylinder on which there rest the sheets 18 which come from the feed 2. The module additionally contains a wiping cylinder 19 and transfer rolls 20 and 21 for transporting the sheets 18 onto the impression cylinder 17.

When the sheets have been printed, they are picked up by the output system 4 which, for example, comprises a chain gripper system 22 and drying means 23 such as lamps. The sheets 18 which are transported by the output system 4 are therefore dried by the drying means 23 before they are stacked in the delivery systems 5 and 6. In addition, in the machine of FIG. 1 a feed device for intermediate sheets 7 is used, with which a protective sheet 24 is placed between each sheet 18 stacked in the delivery systems 5 and 6.

The machine according to the invention will be described in detail with reference to FIG. 2. This machine is identified by the reference number 30 and generally comprises a feed 31 for unprinted sheets 32, which are fed to a printing unit 33 and then, after the end of printing, to a delivery stack 34. The printing unit 33 comprises a plate cylinder 35 and an impression cylinder 36. The machine illustrated in FIG. 2 also simultaneously uses the principle of direct inking and of indirect inking. The direct inking of the plate cylinder is implemented by means of an ink fountain 37 and an ink applicator roll 38. The indirect inking, for its part, is carried out by means of the ink fountains 39, 40 and 41 and their ink applicator rolls 42, 43 and 44. These ink applicator rolls 42, 43 and 44 provide the ink to a collecting inking cylinder 45, which in turn applies the necessary ink to the plates of the plate cylinder 35. In the example illustrated in FIG. 2, the plate cylinder 35 can carry two plates and therefore only a single printing plate is mounted in the present case. The printing module likewise comprises a wiping device with a wiping cylinder 49.

The unprinted sheets 32 are brought from the feed 31 onto the impression cylinder 36 by a suitable transfer system 50, such as a chain gripper system, and are firmly held on this cylinder by means of suitable grippers belonging to the cylinder 36.

Fitted above the impression cylinder 36 and the delivery stack 34 was a feed 46 for intermediate sheets 47. According to the invention, these intermediate sheets 47 are of the same size as the unprinted sheets 32 on which the securities print is to be made and, like the sheets 32, are guided onto the impression cylinder 36 by suitable conventional means, such as a chain gripper system or a transfer roll 48. In this way, the impression cylinder 36 alternately receives an unprinted sheet 32 and an intermediate sheet 47. Since there is only a single plate on the plate cylinder, the adjustment of register between the latter and the sheet 32 which is on the plate cylinder 36 and on which the securities prints are to be printed is carried out: in this way, one of two sheets is printed by the plate, that is to say the sheet 32 which is intended to contain the securities print and the other sheet carried by the impression cylinder 36, which is the intermediate sheet 47, is not printed but takes the same route as the printed sheet in the printing machine 30. In this way, it is possible to obtain a printed sheet and an intermediate sheet 47 alternately in the delivery stack 34, said intermediate sheet effectively protecting the successive printed sheets from one another.

Figure 2:
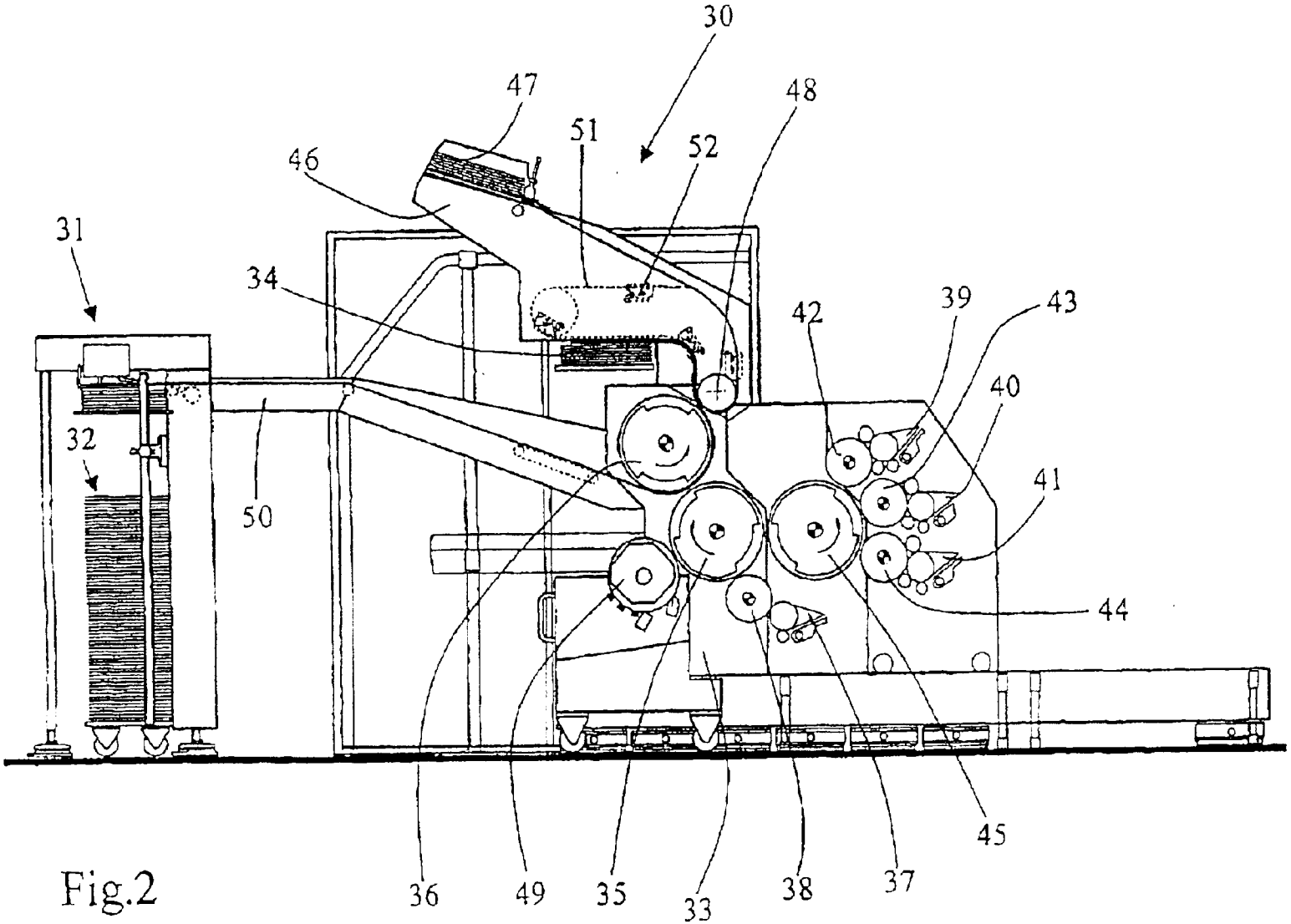
FIG. 2 is a representation of a machine which permits the use of the method according to the invention.

The delivery stack 34 is fed by the impression cylinder 36: following each revolution of the impression cylinder, the sheets carried by it are picked up by a suitable transfer system, for example by a transfer roll operating on the suction principle by means of a vacuum, in order to transfer the sheet, or a system having a chain 51 with grippers 52, as illustrated schematically by dotted lines in FIG. 2. These systems are known in such printing machines in the current prior art.

The intermediate sheets 47 are fed to the impression cylinder 36 by conventional means, for example a gripper chain system, and are transferred to the impression cylinder 36 with the aid of a transfer roll 48.

Figure 3:
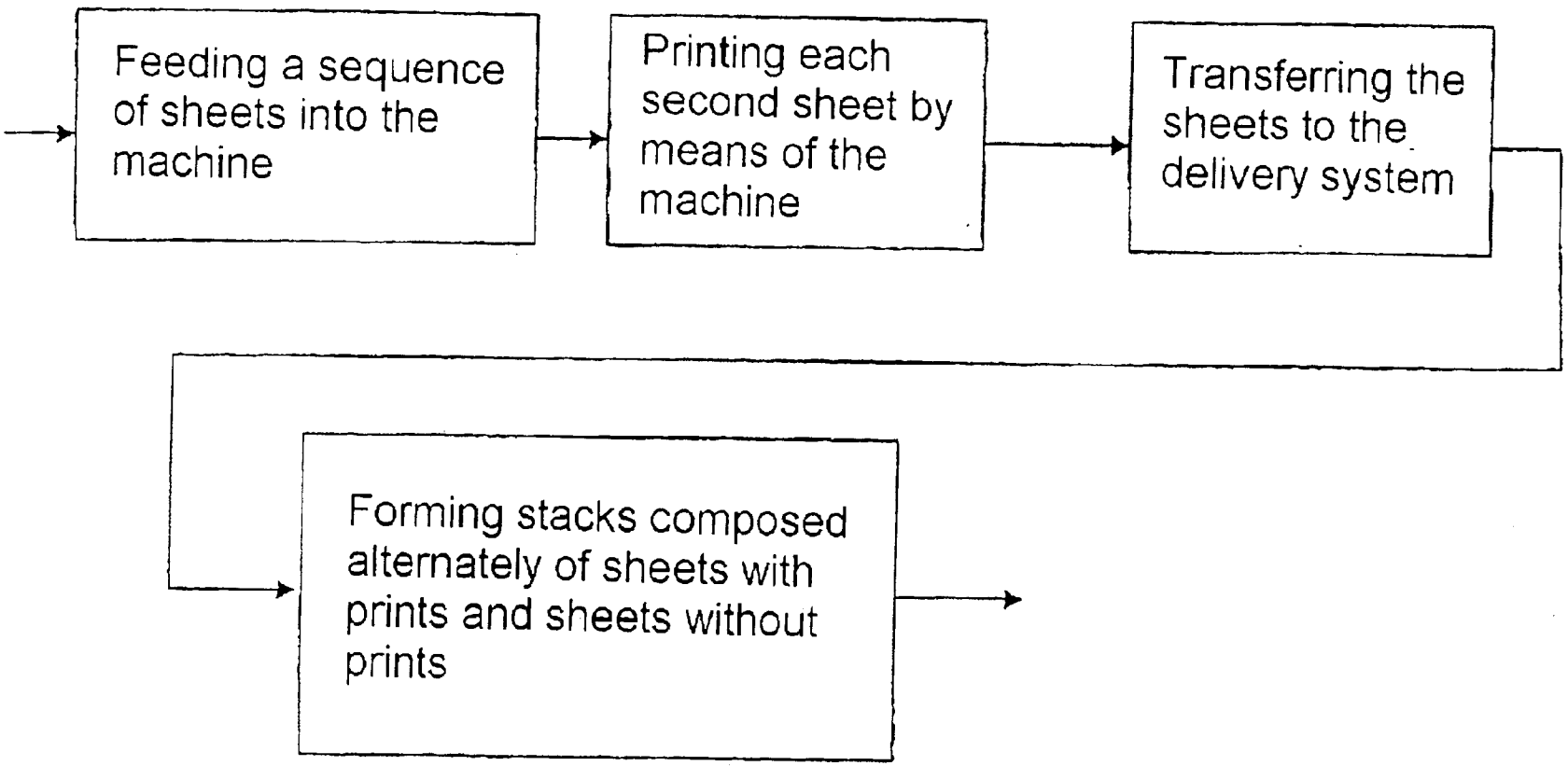
FIG. 3 is a block diagram of the method according to the invention.

FIG. 3 shows a block diagram of the method according to the invention. In the method described, it may be assumed that the impression cylinder carries two sheets, as in the machine illustrated in FIG. 2. In the first stage of the method, an unprinted sheet 32 to be printed and an intermediate sheet 47 are fed alternately to the printing module of the printing machine 30. The variable N is used, as above, in order to define the total number of plates which can be carried by the plate cylinder 35, N being an integer multiple of 2. In FIG. 1, N is equal to 4 and in FIG. 2, N is equal to 2. Thus, with reference to FIGS. 2 and 3, if the printing module 33 is fed alternately with N/2 unprinted sheets 32 to be printed and N/2 intermediate sheets 47, one is in the situation in which the impression cylinder 36 carries a sheet 32 to be printed and an intermediate sheet 47.

As a result of rotation of the impression cylinder 36, the individual prints are printed onto the sheet 32 with the aid of the plate carried by the plate cylinder 35. Irrespective of the number of sheets carried by the impression cylinder 36, in this way each second sheet is printed in the printing machine 30.

When the print has been completed, that is to say when the plate cylinder 35 and the impression cylinder 36 have completed one revolution, the sheets are collected and a sheet stack 34 is formed in the delivery system of the machine, said stack being composed alternately of printed sheets 32 and intermediate sheets 47 which separate the printed sheets 32 from one another.

The invention is not restricted to the types of embodiments described, and modifications are possible. For example, the principle of the invention can be applied in printing machines in which a printing process other than copper printing is used.

The intermediate sheets are preferably unprinted. However, it is also possible to imagine that, in the case of sufficient absorbency of the paper used for the intermediate sheets, this could nevertheless be printed with individual prints. This procedure could be advantageous if N is equal to 2. This is because, in this case, when there is only one plate on the plate cylinder, the rotation of the latter is not balanced and disruptive oscillations can be produced. It would be possible to imagine that a second plate were nevertheless fitted to the plate cylinder and could have on it a simplified printing motif in order to avoid excessively large amounts of ink.

On the other hand, the variable N is not restricted to 2. N can in fact be 4 or 6 or even 8. This number is partly dictated by the size of the sheets to be printed, that is to say the size of the prints and the number of prints per sheet, and also by the diameter of the impression and plate cylinders. On the assumption that N is 4 or 6 or else 8, the uniform function of the machine is improved by a symmetric distribution of the sectors of the plate cylinder which carry a plate, and the sectors on which there is no plate—this symmetric distribution being necessary to produce printed sheets and intermediate sheets alternately—since no imbalance is produced as a result of the absence of a plate.

One advantage of the method according to the invention and of the printing machine which permits the use of the method is the modular construction for small machines. It is actually simple to fit on an intermediate sheet feed above the machine, to insert these sheets into the flow of the unprinted sheets to be printed at the level of the cylinder carrying the sheets and not to interrupt the flow of the sheets stacked in the delivery system of the printing machine. The system described is also very compact, and the necessary space is reduced considerably as compared with a conventional drying system. The system in which the method according to the invention is used is ultimately by far less expensive than a drying system.

Although illustrative embodiments of the invention have been shown and described, a wide range of modification, change and substitution is contemplated in the foregoing disclosure and in some instances, some features of the present invention may be employed without a corresponding use of the other features. Accordingly, it is appropriate that the appended claims be construed broadly and in a manner consistent with the scope of the invention.

What is claimed:

1. A method of producing stacks of sheets which are printed with individual prints, in particular stacks of securities sheets, such as banknotes, from stacks of unprinted sheets, the unprinted sheets running through a printing machine one after another in order to be provided with the individual prints, which comprises the following stages:

feeding a sequence of unprinted sheets and of intermediate sheets alternately into the printing machine, starting from sheet feed devices;

printing the unprinted sheets with the individual prints by means of the printing machine;

transferring the printed sheets and the intermediate sheets to the delivery stack of the machine in such a way that stacks are formed which are composed alternately of printed sheets and intermediate sheets.

2. The method as claimed in claim 1, wherein the unprinted sheets are provided with the prints of securities and the intermediate sheets are not printed.

3. The method as claimed in one of the preceding claims, wherein the prints are copper prints.

* * * * *